US007001316B2

(12) United States Patent
Jakobs et al.

(10) Patent No.: US 7,001,316 B2
(45) Date of Patent: Feb. 21, 2006

(54) DEVICE FOR CARRYING OUT AN ACTIVE MOTION THERAPY METHOD AND SHAPED BODY OF SUCH A DEVICE

(75) Inventors: Ludolf Jakobs, Kerpan (DE); Angelika Werner-Jakobs, Kerpen (DE)

(73) Assignee: Trelogo KG, Kerpen (DE)

( * ) Notice: Subject to any disclaimer, the term of this patent is extended or adjusted under 35 U.S.C. 154(b) by 42 days.

(21) Appl. No.: 10/618,580

(22) Filed: Jul. 15, 2003

(65) Prior Publication Data

US 2004/0266594 A1 Dec. 30, 2004

(30) Foreign Application Priority Data

Jun. 28, 2003 (DE) ..... 203 10 024 U

(51) Int. Cl.
*A63B 71/00* (2006.01)

(52) U.S. Cl. ..... 482/148; 482/34; 482/49; 482/134; 601/22

(58) Field of Classification Search ..... 482/35, 482/134, 49; 607/86; 446/73, 369; 4/574.1, 4/622; 601/22, 27, 28, 154, 155
See application file for complete search history.

(56) References Cited

U.S. PATENT DOCUMENTS 3,977,121 A * 8/1976 Goldfarb et al. ..... 446/369
5,209,345 A * 5/1993 Haugabook ..... 220/832
5,358,763 A * 10/1994 Zinbarg ..... 428/16
5,538,454 A * 7/1996 Kessler ..... 446/236
5,658,226 A * 8/1997 Mentz ..... 482/74
5,673,918 A * 10/1997 Bigari ..... 273/395
5,851,415 A * 12/1998 Thomas ..... 249/117
6,328,691 B1 * 12/2001 Rudischhauser ..... 600/176

FOREIGN PATENT DOCUMENTS

DE 94 07 736 9/1994

* cited by examiner

*Primary Examiner*—Gregory L. Huson
*Assistant Examiner*—L. Amerson
(74) *Attorney, Agent, or Firm*—Paul Vincent

(57) ABSTRACT

A shaped body (1) of plastic material with rounded outer contours is used for carrying out a method of active motion therapy by filling bulk material (11) of shaped bodies (1) into a container (12). The limbs (13) to be trained are immersed into the bulk material (11) and exercises are carried out. The shaped body (1) is symmetrical relative to a first plane defined by a first substantially oval outer periphery (U1) of the shaped body (1), asymmetrical relative to a second plane substantially perpendicular to the first plane and defined by a second substantially oval outer periphery (U2) of the shaped body (1), and asymmetrical relative to a third plane defined by a third outer periphery (U3) of the shaped body (1), which is substantially perpendicular to both the first and second planes. The shaped body effects a resistance to motion which is nearly independent of the exercising direction.

29 Claims, 1 Drawing Sheet

DEVICE FOR CARRYING OUT AN ACTIVE MOTION THERAPY METHOD AND SHAPED BODY OF SUCH A DEVICE

This application claims Paris Convention priority of DE 203 10 024.7 filed Jun. 28, 2003 the complete disclosure of which is hereby incorporated by reference.

BACKGROUND OF THE INVENTION

The invention concerns a plastic shaped body with rounded outer contours for carrying out an active motion therapy method by filling bulk material of shaped bodies into a container, and the limbs to be trained are immersed into the bulk material for carrying out exercises. The invention also concerns a device for carrying out an active motion therapy method with bulk material of plastic shaped bodies having rounded outer contours which can be filled into a container provided for immersing the limbs to be trained into the bulk material for carrying out exercises.

Methods of this type for active motion therapy are known in the art. They were originally used mainly in competitive sport for strengthening limb muscles, in particular for jumping related athletic competition. In the meantime, such methods have found increased use in physiotherapy, e.g. within the scope of rehabilitation measures, in medical training therapy for prophylaxis of joint injuries, and for therapy of peripheral perception disturbances. The user can thereby advantageously perform the respective exercises on a regular basis without supervision at home e.g. with the assistance of instructions on posters. The user thereby immerses the limbs to be trained, e.g. arms or legs, into the shaped body bulk material and carries out certain motions in opposition to the resistance of the shaped bodies, which is substantially greater than that of air. This produces gentle muscle build-up and has a positive massaging effect as mechanical contact to the shaped bodies increases blood circulation.

The conventional shaped bodies were usually natural substances such as peas, beans, lentils, corn or the like. Such natural shaped bodies disadvantageously have the risk of being destroyed under prolonged wear to produce granular residue of various sizes. The use of natural shaped bodies also involves hygienic problems, in particular infestation with microorganisms, fungus, bacteria etc.

DE 94 077 36 describes a device of this type having shaped body bulk made from a plastic material which, however, is not described in detail but which does overcome the above-mentioned disadvantages of shaped bodies made from natural substances. The shaped bodies are thereby shaped either entirely asymmetrically in a form of natural substances such as beans, peas, lentils or corn or are symmetrical with the shape of geometrical bodies such as spheres or cylinders.

It is therefore the underlying purpose of the present invention to further develop a shaped body or a device with bulk material of shaped bodies of the above-mentioned type to effect an even resistance which is largely independent of the direction while carrying out active motion therapy with limbs are to be trained being immersed in the bulk material.

SUMMARY OF THE INVENTION

The first part of this object is achieved in accordance with the invention with a shaped body of the above-mentioned type in that the shaped body is symmetrical relative to a first plane defined by a first substantially oval outer periphery of the shaped body, is asymmetrical relative to a second plane substantially perpendicular thereto and defined by a second substantially oval outer periphery of the shaped body, and is asymmetrical relative to a third plane defined by a third outer periphery of the shaped body which is substantially perpendicular to both the first plane, relative to which the shaped body is symmetrical, as well as to the second plane, relative to which the shaped body is asymmetrical.

It has surprisingly turned out that the inventive design of the shaped body having one symmetrical plane and two asymmetrical planes which are all disposed substantially perpendicular with respect to each other, produces a practically constant, direction-independent resistance when the limbs are immersed into the bulk material of such shaped bodies and exercises are carried out against the increased resistance produced by the shaped bodies. The substantially constant resistance to motion in any spatial direction avoids both training phases with no or little load as well as training phases in which an excessively high resistance must be overcome. Motion therapy with bulk material of the inventive shaped bodies is initially experienced as being relatively easy. However, the muscles being trained tire uniformly and relatively quickly, since recovering times are avoided. Excessive load on certain muscle components is reliably prevented as is insufficient training of other muscle components.

To provide a particularly effective, nearly direction-independent constant resistance of bulk material with the inventive shaped bodies, a preferred embodiment provides that the shaped body is asymmetrical at least relative to its third plane defined by its third substantially oval maximum outer periphery. For the same purpose, the shaped body may alternatively or additionally be asymmetrical at least relative to the second plane defined by its second substantially oval minimum outer periphery. In any case, the shaped body is asymmetrical relative to two substantially mutually perpendicular planes, and is symmetrical relative to one plane which is substantially perpendicular to one of the two planes relative to which the shaped body is asymmetrical, wherein one of the two planes relative to which the shaped body is asymmetrical, is that plane which is defined by either the maximum or the minimum outer periphery of the shaped body.

In particular, it may be advantageous if the shaped body is asymmetrical relative to the second plane defined by its second substantially oval minimum outer periphery and also relative to its third plane defined by its third substantially oval maximum outer periphery. In this case, the first outer periphery of the shaped body which defines its symmetrical plane has a size value between the sizes of the outer peripheries which are substantially perpendicular thereto and to which the shaped body is asymmetrical.

The shaped body may thereby only be symmetrical relative to the first plane defined by its first substantially oval outer periphery, i.e. the shaped body has only one symmetry plane.

Investigations have shown that the asymmetrical shape of the shaped body relative to the planes which are substantially perpendicular to the symmetrical plane of the shaped body, can be varied within relatively large limits to obtain the desired effect. It is thereby preferably provided that at least one of the planes defined by the second or third outer periphery of the shaped body to which the shaped body is asymmetrical, intersects a connecting line, which is perpendicular thereto and which connects the outer contour of the shaped body above this plane with the outer contour of the shaped body below this plane, in a length ratio between 1:1.5 and 1:5.

In a further preferred embodiment, the third plane defined by the third substantially oval maximum outer periphery of the shaped body to which the shaped body is asymmetrical, intersects a connecting line perpendicular thereto, which connects the outer contour of the shaped body above this plane with the outer contour of the shaped body below this plane, in a ratio between 1:1.5 and 1:5.

It is particularly advantageous when the second plane defined by the second outer periphery of the shaped body and also the third plane defined by the third outer periphery of the shaped body to both of which the shaped body is asymmetrical, each intersect a connecting line perpendicular thereto each of which connects the outer contour of the shaped body above the respective plane to the outer contour of the shaped body below the respective plane, both in a length ratio between 1:1.5 and 1:5, i.e. the degree of asymmetry of both planes which are substantially perpendicular to the symmetry plane of the shaped body and also to each other, is substantially identical.

The ratio of the connecting line, perpendicular to and intersecting the plane defined by the respective outer periphery of the shaped body and with respect to which the shaped body is asymmetrical, which connects the outer contour of the shaped body above this plane with the outer contour of the shaped body below this plane, is preferably between 1:1.5 and 1:3.5, in particular approximately 1:2.

The shaped body is preferably made from a thermoplastic material. The shaped bodies can then be produced in a simple fashion using any thermoplastic processing methods such as extrusion, injection-molding etc. Injection molds may be used which have a plurality of mold cavities for the shaped bodies, wherein the mold cavities have connecting channels communicating with a common injection channel. The use of thermoplastic materials is more ecological and, in particular, recycling is facilitated.

In this connection, it is also advantageous when the plastic material of the shaped body is a plastic material which contains no halogen, in particular no chlorine.

The plastic material of the shaped body preferably consists of a polyolefin, such as polyethylene, polypropylene, polyethyleneterephtalate or the like, in particular of polypropylene or a polymer blend containing polypropylene.

If the shaped bodies are colored, preferably at least one pigment or the like is added to the plastic material of the shaped body. Such coloring-through of the plastic material is advantageous compared to conventional painting of such shaped bodies, since surface damage to the paint with possible formation of sharp-edged paint fragments due to abrasion cannot occur.

To ensure maximum protection for children who are in contact with the inventive shaped bodies, the colorant, pigment or the like is preferably a food coloring and contains, in particular, no toxic components, e.g. heavy metals which could migrate from the plastic matrix of the shaped body.

For the same purpose, the colorant, pigment or the like preferably comprises a different color than that conventionally used in food, e.g. black, grey, blue or the like.

The outer dimensions and also the respective asymmetry of the shaped bodies can be varied relative to the planes which are substantially perpendicular to the symmetry plane of the shaped body within relatively large limits. These dimensions preferably lie in the range of the conventional shaped bodies of the above-mentioned natural substances. The inventive shaped body preferably has a length of between 0.4 cm and 4.0 cm, a width of between 0.3 cm and 3.0 cm and a height of between 0.2 cm and 2.0 cm.

To solve the second part of the inventive object, a device is provided in accordance with the invention for carrying out a method of active motion therapy comprising plastic shaped body bulk material with rounded outer contours which can be filled into a container which is provided for training limbs immersed in the bulk material while carrying out exercises, wherein the bulk material comprises at least some of the shaped bodies of the above-mentioned type such that exercises which are carried out in a bulk material comprising such shaped bodies, produce a practically constant, direction-independent resistance due to the geometry of the shaped bodies.

In a preferred embodiment, substantially all shaped bodies of the bulk material are formed in the above-mentioned fashion.

In a further development, the bulk material is formed from shaped bodies of different sizes of which at least some, preferably substantially all, shaped bodies have the inventive asymmetrical configuration with two planes, which are perpendicular relative to the symmetry plane of the shaped body and to each other, relative to which the shaped bodies are asymmetrical. The different sizes produce a bulk material volume density which is particularly effective for motion therapy, wherein the resistance can be varied within certain limits in dependence on the size and/or mixture ratio of the different shaped bodies. In particular, shaped bodies of two different sizes may be provided.

If such bulk material with shaped bodies of different sizes is used, the length ratio and/or the width ratio between the larger shaped bodies and the smaller shaped bodies is preferably between 1.3:1 and 3:1, in particular between 1.3:1 and 2:1. The thickness ratio between larger and smaller shaped bodies is preferably approximately 1:1, i.e. the shaped bodies preferably have the same thickness. The thickness ratio between larger and smaller shaped bodies may also be chosen to be in a region which corresponds approximately to that of the length or width.

The mixing ratio between larger shaped bodies and smaller shaped bodies is preferably between 1.5:1 and 3:1, in particular approximately 2:1.

To improve observation of the motion therapy by the therapist, a preferred embodiment provides a transparent container, preferably made from a plastic material for accommodating the shaped body bulk material. The plastic material may also be made from a thermoplastic material, in particular a polyolefin.

The invention is explained in more detail below by embodiments with reference to the drawing.

DESCRIPTION OF THE PREFERRED EMBODIMENT

Figure 1A:
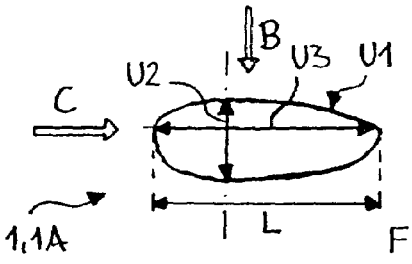
FIG. 1A shows a side view of an embodiment of an inventive shaped body.
Figure 1B:
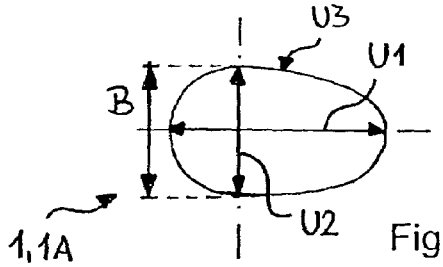
FIG. 1B shows a top view onto the shaped body of FIG. 1A in the direction of arrow B.
Figure 1C:
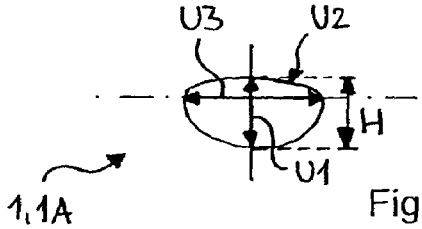
FIG. 1C shows a front view of the shaped body of FIG. 1A in the direction of arrow C.

FIG. 1 shows a plastic shaped body 1A for carrying out a method of active motion therapy. FIG. 1A shows a side view of the shaped body 1A. The same shaped body 1A is shown in FIG. 1B in top view (in the direction of arrow B of FIG. 1A) and in FIG. 1C in front view (in the direction of arrow C of FIG. 1A). As seen in FIGS. 1A through 1C, the shaped body 1A has rounded outer contours which are exclusively convex curved about its entire surface.

As can preferably be seen in FIG. 1C, the shaped body 1A is symmetrical relative to a first plane defined by a first substantially oval outer periphery U1 of the shaped body 1A, i.e. this plane divides the shaped body 1A into two mirror-symmetrical halves.

The shaped body 1A is asymmetrical relative to a second plane defined by a second substantially oval outer periphery U2 of the shaped body 1A which is perpendicular to the symmetry plane of the shaped body 1A defined by the outer periphery U1, wherein this plane is the plane defined by the minimum outer periphery U2 of the shaped body 1A (see in particular FIG. 1C).

Likewise, the shaped body 1A is asymmetrical relative to a third plane which is defined by a third substantially oval outer periphery U3 of the shaped body 1A, and which is perpendicular to the symmetry plane defined by the first outer periphery U1 of the shaped body 1A and also to the plane which is perpendicular thereto and defined by the second outer periphery U2 relative to which the shaped body 1A is asymmetrical (see in particular FIG. 1A). The third plane is the plane defined by the maximum outer periphery U3 of the shaped body 1A (see in particular FIG. 1B).

The shaped body 1A is therefore asymmetrical relative to two planes which are perpendicular to each other and which are defined by the minimum outer periphery U2 and the maximum outer periphery U3 of the shaped body 1A and is symmetrical, i.e. mirror-symmetrical relative to the plane defined by its central outer periphery U1 which is perpendicular to the two above-mentioned planes. In the present embodiment, the shaped body 1A is thereby only symmetrical relative to the one plane defined by its substantially oval outer periphery U1 (FIG. 1C).

As can be gathered from FIG. 1A, the third plane defined by the maximum outer periphery U3 of the shaped body 1A intersects a connecting line perpendicular thereto, which connects the outer contour of the shaped body 1 above this plane with the outer contour of the shaped body 1 below this plane (see e.g. projection of the outer periphery U2 in FIG. 1A), in a ratio of approximately 1:2, i.e. the plane defined by the outer periphery U3 divides the shaped body 1A into two parts with the upper part of FIG. 1A being approximately half the thickness of the lower part of FIG. 1A.

The same is true for the second plane defined by the minimum outer periphery U2 of the shaped body 1A. This plane also intersects a connecting line which is perpendicular thereto, and which connects the outer contour of the shaped body 1A above this plane with the outer contour of the shaped body 1A below this plane (see e.g. projection of the outer periphery U1 in FIG. 1B), in a ratio of approximately 1:2 i.e. the plane defined by the outer periphery U2 divides the shaped body 1A into two parts wherein the left part of FIG. 1B has half the thickness of the right-hand part of the shaped body 1A of FIG. 1B.

As indicated above, the outer dimensions of the shaped body 1 may vary within relatively large limits. The shaped body 1A shown in FIGS. 1A through 1C has e.g. a length of approximately 2.0 cm, a width B of approximately 1.4 cm and a height H of approximately 0.6 cm.

Figure 2A:
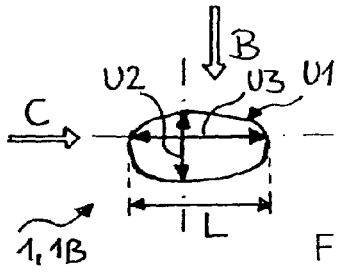
FIG. 2A shows a side view of an alternative embodiment of an inventive shaped body.
Figure 2B:
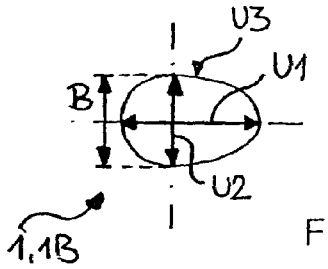
FIG. 2B shows a top view onto the shaped body of FIG. 2A in the direction of arrow B.
Figure 2C:
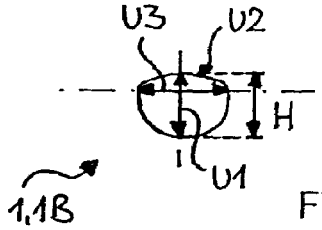
FIG. 2C shows a top view onto the shaped body of FIG. 2A in the direction of arrow C.

The plastic shaped body 1B of FIGS. 2A through 2C differs from the plastic shaped body 1A of FIG. 1A through 1C in that its length L and width B are reduced compared thereto while the height H of the shaped body 1B substantially corresponds to the height H of the shaped body 1A. The length L of the shaped body 1B is e.g. approximately 1.3 cm while the width B of the shaped body 1B is approximately 1.0 cm. In correspondence with the shaped body 1A of FIGS. 1A through 1C, the shaped body 1B has rounded outer contours which are exclusively convex over its entire surface.

In correspondence with the shaped body 1A, the shaped body 1B also has a symmetry plane defined by a first substantially oval outer periphery U1 (see in particular FIG. 2C) while the shaped body 1B is asymmetrical relative to a third plane which is perpendicular thereto and defined by its substantially oval maximum outer periphery U3 as well as relative to a second plane which is perpendicular to the symmetric plane and to the third plane and which is defined by its substantially oval minimum outer periphery U2. Corresponding to the shaped body 1A, the mutually perpendicular planes defined by the outer peripheries U2, U3 divide the shaped body 1B into a ratio of approximately 1:2.

The shaped bodies 1A, 1B are preferably made from a thermoplastic, preferably halogen-free plastic material such as polyolefin, e.g. polypropylene or a polymer blend containing polypropylene. If coloring of the shaped body 1A, 1B is desired, a preferably non-toxic colorant, pigment or the like is added to the plastic material thereof which has a different color than conventional coloring in food. The shaped bodies 1A, 1B may be colored e.g. blue and/or grey.

Figure 3:
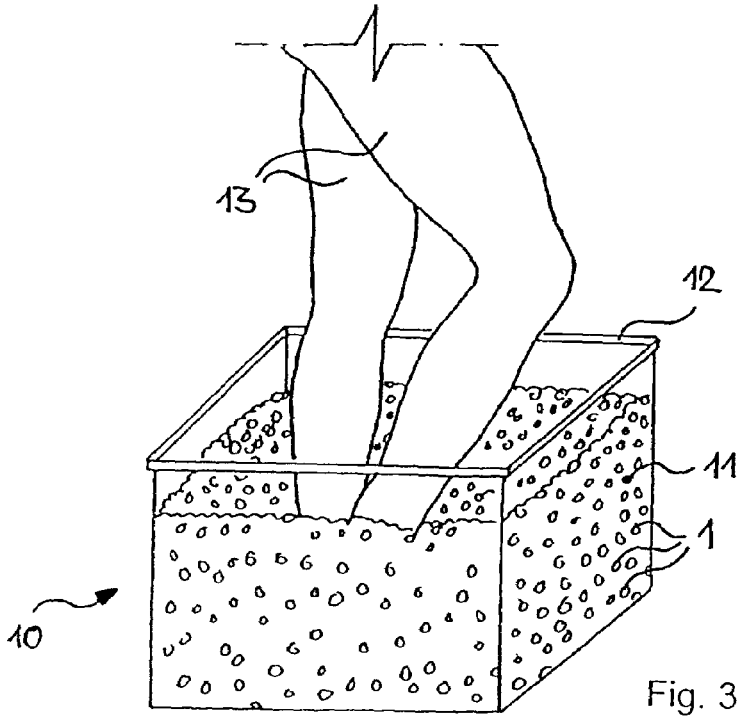
FIG. 3 shows a device during motion therapy with shaped body bulk material in accordance with FIG. 1 and/or FIG. 2.

FIG. 3 shows a device 10 for carrying out a method of active motion therapy wherein bulk material 11 of shaped bodies 1 in accordance with FIG. 1 and/or FIG. 2 is filled into a container 12, and the limbs 13 to be trained, in the present case the legs of a user, are immersed into the bulk material 11 for carrying out exercises. In the present case, the bulk material 11 comprises the shaped bodies 1A of FIG. 1A through FIG. 1C as well as the shaped bodies 1B of FIGS. 2A through 2C, wherein the mixing ratio between the larger shaped bodies 1A and the smaller shaped bodies 1B is preferably approximately 2:1, i.e. the bulk material contains twice as many larger shaped bodies 1A than smaller shaped bodies 1B.

This bulk material 11 has a nearly constant, direction-independent resistance when a limb 13 is immersed into the bulk material 11 for carrying out exercises against the increased resistance produced by the shaped bodies 1A, 1B such that both training phases without load or with little load are avoided as are training phases in which an excessively large resistance must be overcome. Moreover, the selected mixing ratio between the larger shaped bodies 1A and the smaller shaped bodies 1B of approximately 2:1 produces a bulk material 11 volume density which is particularly effective for active motion therapy.

The container 12 accommodating the bulk material 11 consists essentially of a transparent plastic material, e.g. also of polypropylene or a polymer blend containing polypropylene to improve external observation of the motions of the trained limbs 13 in the bulk material.

We claim:

1. A method of active motion therapy of limbs to be trained using a bulk material of shaped body plastic pieces having rounded outer contours, the method comprising the steps of:

a) filling the bulk material of plastic pieces into a container;

b) immersing the limb to be trained into the container and into the bulk material of plastic pieces; and c) exercising the limb within the bulk material following step b), wherein the shaped body plastic pieces comprise a first plane defined by a first substantially oval outer periphery of the shaped body, the shaped body being symmetrical relative to said first plane, a second plane substantially perpendicular to said first plane and defined by a second substantially oval outer periphery of the shaped body, the shaped body being asymmetrical relative to said second plane, and a third plane defined by a third outer periphery of the shaped body, said third plane being substantially perpendicular to said first plane and to second plane, said shaped body being asymmetrical relative to said third plane.

2. The method of claim 1, wherein said third substantially oval outer periphery is a maximum outer periphery of the shaped body.

3. The method of claim 1, wherein said second substantially oval outer periphery is a minimum outer periphery of the shaped body.

4. The method of claim 2, wherein said second substantially oval outer periphery is a minimum outer periphery of the shaped body.

5. The method of claim 1, wherein the shaped body is symmetrical only relative to said first plane defined by said first substantially oval outer periphery.

6. The method of claim 1, wherein at least one of said second and said third planes divides a line segment, perpendicular to said second or third plane and extending from an outer contour of the shaped body above said second or said third plane to an outer contour of the shaped body below said second or said third plane, into two partial segments having a mutual length ratio of between 1:1.5 and 1:5.

7. The method of claim 1, wherein said third plane is defined by a maximum outer periphery of the shaped body and defines a line segment, perpendicular to said third plane and extending from an outer contour of the shaped body above said third plane to an outer contour of the shaped body below said third plane, into two partial segments having a mutual length ratio of between 1:1.5 and 1:5.

8. The method of claim 6, wherein said ratio is between 1:1.5 and 1:3.5.

9. The method of claim 7, wherein said ratio is between 1:1.5 and 1:3.5.

10. The method of claim 6, wherein said ratio is approximately 1:2.

11. The method of claim 7, wherein said ratio is approximately 1:2.

12. The method of claim 1, wherein the shaped body consists essentially of a thermoplastic material.

13. The method of claim 1, wherein the shaped body contains substantially no chlorine.

14. The method of claim 1, wherein the shaped body consists essentially of polyolefin.

15. The method of claim 1, wherein said shaped body comprises a colorant or pigment.

16. The method of claim 15, wherein said colorant or pigment is non-toxic.

17. The method of claim 16, wherein said colorant or pigment has a color different from that of conventional food.

18. The method of claim 1, wherein the shaped body has a length between 0.4 cm and 4.0 cm, a width between 0.3 cm and 3.0 cm and a height between 0.2 cm and 2.0 cm.

19. The method of claim 1, wherein the bulk material is formed of shaped bodies of different sizes.

20. The method of claim 19, wherein the shaped bodies are provided into two different sizes.

21. The method of claim 19, wherein at least one of a length ratio and a width ratio between larger shaped bodies and smaller shaped bodies is between 1.3:1 and 3:1.

22. The method of claim 21, wherein a least one of said length ratio and said width ratio between larger shaped bodies and smaller shaped bodies is between 1.3:1 and 2:1.

23. The method of claim 19, wherein a thickness ratio between larger shaped bodies and smaller shaped bodies is approximately 1:1.

24. The method of claim 19, wherein a mixing ratio between larger shaped bodies and smaller shaped bodies is between 1.5:1 and 3:1.

25. The method of claim 24, wherein said mixing ratio is approximately 2:1.

26. The method of claim 1, wherein said container is transparent.

27. The method of claim 26, wherein said container is made from a plastic material.

28. The method of claim 1, wherein the shaped body consists essentially of a plastic material which contains no halogen.

29. The method of claim 1, wherein the shaped body consists essentially of one of polypropylene and a polymer blend containing polypropylene.

* * * * *